US009646561B2

(12) United States Patent
Lee et al.

(10) Patent No.: US 9,646,561 B2
(45) Date of Patent: May 9, 2017

(54) TESTABLE DATA DRIVER AND DISPLAY DEVICE INCLUDING THE SAME

(71) Applicant: SAMSUNG DISPLAY CO., LTD., Yongin, Gyeonggi-Do (KR)

(72) Inventors: Jae-Han Lee, Hwaseong-si (KR); Sun-Koo Kang, Seoul (KR); Sooyeon Kim, Seoul (KR); Young-Il Ban, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 96 days.

(21) Appl. No.: 14/818,352

(22) Filed: Aug. 5, 2015

(65) Prior Publication Data

US 2016/0171951 A1 Jun. 16, 2016

(30) Foreign Application Priority Data

Dec. 15, 2014 (KR) ..... 10-2014-0180569

(51) Int. Cl.
*G09G 5/00* (2006.01)
*G09G 3/36* (2006.01)
*G09G 3/00* (2006.01)

(52) U.S. Cl.
CPC ..... *G09G 3/3688* (2013.01); *G09G 3/006* (2013.01); *G09G 2300/0426* (2013.01); *G09G 2310/027* (2013.01)

(58) Field of Classification Search
CPC combination set(s) only.
See application file for complete search history.

(56) References Cited

U.S. PATENT DOCUMENTS

2003/0126525 A1* 7/2003 Miyashita ..... G11C 29/006 714/718
2004/0148123 A1* 7/2004 Abe ..... G01R 31/2884 702/120
2014/0139509 A1 5/2014 Kim
2015/0370067 A1* 12/2015 Denduluri ..... G02B 27/0101 345/8

FOREIGN PATENT DOCUMENTS

KR 1019880011649 10/1988
KR 1020100118996 11/2010
KR 1020110125400 11/2011
(Continued)

*Primary Examiner* — Van Chow
(74) *Attorney, Agent, or Firm* — F. Chau & Associates, LLC

(57) ABSTRACT

A display device includes a display panel, a gate driver, a data driver, and a driving control unit. The display panel includes pixels connected to a corresponding one of gate lines and a corresponding one of data lines. The gate driver drives the gate lines. The data driver includes first pads and second pads. The first pads are connected to each of first data lines of the data lines, and the second pads are connected to each of second data lines of the data lines. The driving control unit provides control signals and a data signal to the data driver, and to control the gate driver. The data driver includes a digital-to-analog converter and a switching circuit. The digital-to-analog converter converts the data signal into analog signals. The switching circuit sequentially outputs the analog signals to the first pads during a test mode.

17 Claims, 4 Drawing Sheets

(56) References Cited

FOREIGN PATENT DOCUMENTS

| | | |
|---|---|---|
| KR | 1020120075096 | 7/2012 |
| KR | 1020130020725 | 2/2013 |
| KR | 1020130031054 | 3/2013 |
| KR | 1020130066275 | 6/2013 |
| KR | 1020130103859 | 9/2013 |
| KR | 1020140051004 | 4/2014 |

* cited by examiner

TESTABLE DATA DRIVER AND DISPLAY DEVICE INCLUDING THE SAME

CROSS-REFERENCE TO RELATED APPLICATIONS

This U.S. non-provisional patent application claims priority under 35 U.S.C. §119 to Korean Patent Application No. 10-2014-0180569, filed on Dec. 15, 2014, in the Korean Intellectual Property Office, the disclosure of which is incorporated by reference herein in its entirety.

TECHNICAL FIELD

The present inventive concept relates to a display device, and more particularly, to a display device for testing a data driver in the display device.

DISCUSSION OF THE RELATED ART

A display device includes a display panel for displaying an image, and a data driver and a gate driver for driving the display panel. The display device might not display a desired image if the data driver has a defect, and thus, output signals of the data driver may be tested or monitored.

SUMMARY

According to an embodiment of the present inventive concept, a display device includes a display panel, a gate driver, a data driver, and a driving control unit. The display panel includes a plurality of pixels. Each of the plurality of pixels is connected to a corresponding one of a plurality gate lines and a corresponding one of a plurality of data lines. The gate driver is configured to drive the plurality of gate lines. The data driver includes a plurality of pads. The plurality of pads includes a first group of pads and a second group of pads. Each of the first group of pads is connected to each of a first group of data lines of the plurality of data lines, and each of the second group of pads is connected to each of a second group of data lines of the plurality of data lines. The driving control unit is configured to provide control signals and a data signal to the data driver, and to control the gate driver. The data driver includes a digital-to-analog converter and a switching circuit. The digital-to-analog converter is configured to convert the data signal into a plurality of analog signals corresponding to each of the plurality of data lines. The switching circuit is configured to connect each of a plurality of output terminals of the digital-to-analog converter to a corresponding one of the plurality of pads at substantially the same time during a normal mode. During a test mode, the switching circuit is further configured to connect each of a first group of output terminals of the plurality of output terminals to a corresponding one of the first group of pads in a first period, and to connect each of a second group of output terminals of the plurality of output terminals to a corresponding one of the first group of pads in a second period subsequent to the first period.

At least one of the first group of pads may contact a probe.

The control signals may include a test mode signal and a clock signal. The test mode signal may indicate the normal mode or the test mode.

The data driver may further include a test control unit. The test control unit may be configured to output a plurality of selection signals in response to the test mode signal.

The data driver may further include a plurality of buffers corresponding to each of the plurality of pads.

The switching circuit may include a first switching unit. The first switching unit may be configured to provide a first group of analog signals of the plurality of analog signals to a corresponding one of a first group of buffers of the plurality of buffers in response to a first selection signal of the plurality of selection signals. The first group of buffers may correspond to each of the first group of pads.

The switching circuit may include a plurality of test output lines, a second switching unit, and a third switching unit. The second switching unit may be configured to connect each of the plurality of test output lines to a corresponding one of a second group of buffers of the plurality of buffers in response to the test mode signal. Each of the second group of buffers may correspond to each of the first group of pads. The third switching unit may be configured to connect each of a third group of buffers of the plurality of buffers to one of the plurality of test output lines in response to a corresponding selection signal of the plurality of selection signals.

The test control unit may output the plurality of selection signals in synchronization with the clock signal when the test mode signal is in a first level.

The test control unit may sequentially activate the plurality of selection signals every predetermined period of the clock signal when the test mode signal is in the first level.

An area of each of the first group of pads may be broader than an area of each of the second group of pads.

According to an embodiment of the present inventive concept, a data driver is provided. The data driver includes a digital-to-analog converter, a test control unit, a plurality of pads, and a switching circuit. The digital-to-analog converter is configured to convert a data signal into a plurality of analog signals corresponding to each of a plurality of data lines. The test control unit is configured to output a plurality of selection signals in response to a test mode signal. Each of the plurality of pads is connected to a corresponding one of the plurality of data lines. The plurality of pads includes a first group of pads and a second group of pads. The switching circuit is configured to output each of a first group of the plurality of analog signals to a corresponding one of the first group of pads in a first period, and to output each of a second group of the plurality of analog signals to a corresponding one of the first group of pads in a second period subsequent to the first period during a test mode.

At least one of the first group of pads contacts a probe.

The data driver may further include a plurality of buffers corresponding to each of the plurality of pads.

The switching circuit may include a first switching unit. The first switching unit may be configured to provide a first group of analog signals of the plurality of analog signals to a corresponding one of a first group of buffers of the plurality of buffers in response to a first selection signal of the plurality of selection signals. The first group of buffers may correspond to each of the first group of pads.

The switching circuit may further include a plurality of test output lines and a second switching unit. The second switching unit may be configured to connect each of the plurality of test output lines to a corresponding one of a second group of buffers of the plurality of buffers in response to the test mode signal. The second group of buffers may correspond to each of the first group of pads.

The switching circuit may further include a third switching unit. The third switching unit may be configured to connect each of a third group of buffers of the plurality of buffers to one of the plurality of test output lines in response to a corresponding selection signal of the plurality of selection signals.

An area of each of the first group of pads may be broader than an area of each of the second group of pads.

BRIEF DESCRIPTION OF THE DRAWINGS

A more complete appreciation of the present invention and many of the attendant aspects thereof will be readily obtained as the same becomes better understood by reference to the following detailed description when considered in connection with the accompanying drawings, wherein.

DETAILED DESCRIPTION OF THE EMBODIMENTS

Hereinafter, exemplary embodiments of the present inventive concept are described in more detail with reference to the accompanying drawings.

Figure 1:
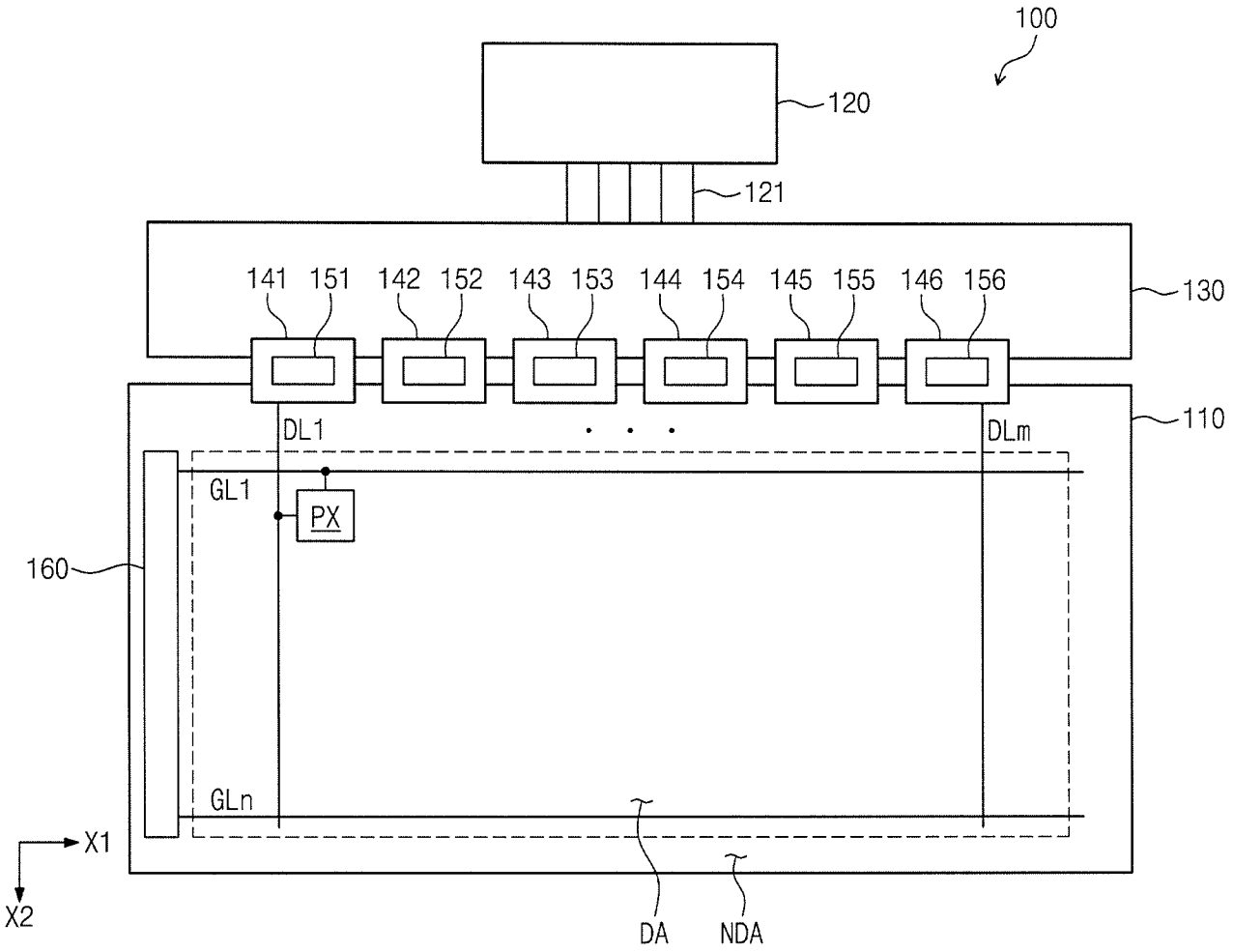
FIG. 1 is a plan view of a display device according to an embodiment of the present inventive concept.

FIG. 1 is a plan view of a display device according to an embodiment of the present inventive concept.

Referring to FIG. 1, the display device 100 includes a display panel 110, a driving control unit 120, a printed circuit board 130, a plurality of data driving circuits 141 to 148, and a gate driver 160.

The display panel 110 includes a display area DA including a plurality of pixels PX and a non display area NDA adjacent to the display area DA. The display area DA is an area where an image is displayed and the non display area is an area where no image is displayed. The display panel 110 may include a glass substrate, a silicon substrate, a film substrate, or the like.

The printed circuit board 130 may include various circuits for driving the display panel 110. The printed circuit board 130 may include a plurality of wires to be connected to the driving control unit 120, the data driving circuits 141 to 146, and the gate driver 160.

The driving control unit 120 is electrically connected to the printed circuit board 130 through a cable 121. In an embodiment of the present inventive concept, the driving control unit 120 may be directly mounted on the printed circuit board 130.

The driving control unit 120 provides a data signal DATA and a first control signal CONT1 to the data driving circuits 141 to 146 through the cable 121 and provides a second control signal CONT2 to the gate driver 160. The first control signal CONT1 may include a horizontal sync start signal, a clock signal, a line latch signal, a polarity control signal, and a test mode signal. The second control signal CONT2 may include a vertical synch start signal, an output enable signal, and a gate pulse signal.

Each of the data driving circuits 141 to 146 may be implemented using a tape carrier package (TCP) or a chip on film (COF) and data driver integrated circuits (ICs) 151 to 156 are respectively mounted thereon. Each of the data driver ICs 151 to 156 drives a plurality of data lines in response to the data signal DATA and the first control signal CONTI provided from the driving control unit 120. In an embodiment of the present inventive concept, the data driver ICs 151 to 156 may be directly mounted on the display panel instead of the printed circuit board 130. Each of the data drivers ICs 151 to 156 drives corresponding data lines among data lines DL1 to DLm (where m is a positive integer).

The plurality of data driving circuits 141 to 146 are sequentially arranged at a first side of the display panel 110 in a first direction X1. The gate driver 160 is disposed at a second side of the display panel 110.

The gate driver 160 is implemented with an amorphous silicon gate (ASG) using an amorphous silicon thin film transistor (a-Si TFT) and a circuit using an oxide semiconductor, a crystalline semiconductor, a polycrystalline semiconductor, or the like, and integrated into the non display area NDA of the display panel 110. In an embodiment of the present inventive concept, the gate driver 160 may be implemented with a tape carrier package (TCP), a chip on film (COF), or the like.

The gate driver 160 drives gate lines GL1 to GLn (where n is a positive integer) in response to the second control signal CONT2 provided from the driving control unit 120. When a gate on voltage VON is applied to a first gate line of the gate line GL1 to GLn, a thin film transistor (TFT) connected to the first gate line is turned on and the data driver ICs 151 to 156 provide data driving signals corresponding to the data signal DATA to the data lines DL1 to DLm. The data driving signals provided to the data lines DL1 to DLm are applied to a corresponding pixel through the turned-on TFT.

Figure 2:
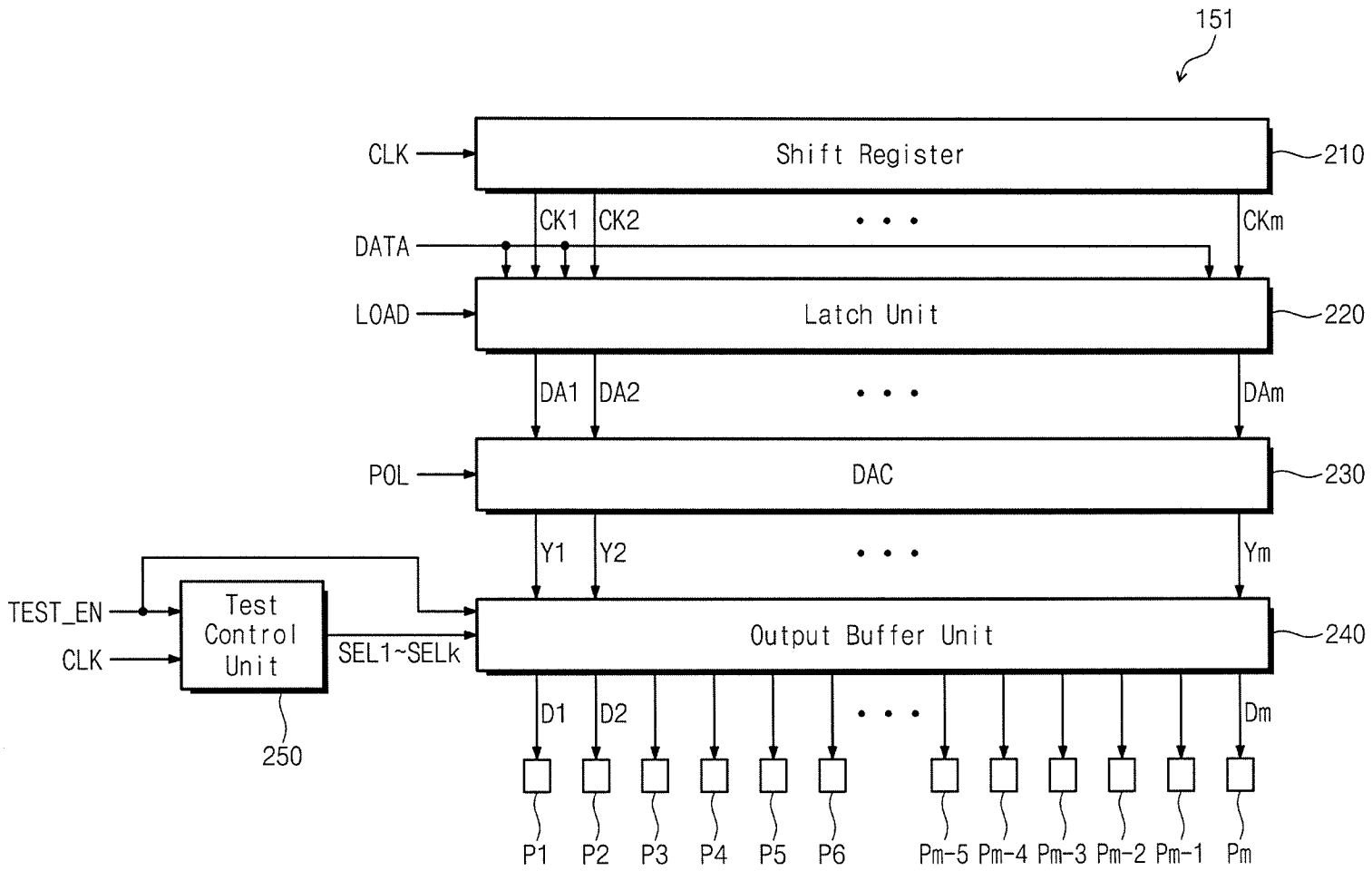
FIG. 2 is a block diagram illustrating a configuration of a data driver integrated circuit (IC) shown in FIG. 1 according to an embodiment of the present inventive concept.

FIG. 2 is a block diagram illustrating a configuration of a data driver IC shown in FIG. 1 according to an embodiment of the present inventive concept. FIG. 2 illustrates only the data driver IC 151 among the data driver ICs 151 to 156 shown in FIG. 1, but the remaining data driver ICs 152 to 156 have substantially the same circuit configuration as the data driver IC 151 and perform similar operations to that of the data driver IC 151.

Referring to FIG. 2, the data driver IC 151 includes a shift register 210, a latch unit 220, a digital to analog converter 230, an output buffer unit 240, a test control unit 250, and a plurality of pads P1 to Pm. The plurality of pads P1 to Pm respectively correspond to the data lines DL1 to DLm shown in FIG. 1. Some of the plurality of pads P1 to Pm are testable pads. For example, the testable pads may contact a monitoring probe. In the exemplary embodiment described with reference to FIG. 2, the pads P1, P2, P3, Pm-2, Pm-1, and Pm are testable pads.

The shift register 210 sequentially activates latch clock signals CK1 to CKm in synchronization with a clock signal CLK. The latch unit 220 latches the data signal DATA in synchronization with the latch clock signals CK1 to CKm activated by the shift register 210 and simultaneously provides digital data signals DA1 to DAm to the digital-to-analog converter 230 in response to a line latch signal LOAD.

The digital-to-analog converter 230 converts the digital data signals DA1 to DAm provided from the latch unit 220 into analog image signals Y1 to Ym in response to a polarity control signal POL, and outputs the analog image signals Y1 to Ym to the output buffer unit 240. The polarity control signal POL is included in the first control signal CONT1 which is provided from the driving control unit 120 shown in FIG. 1 to the data driving circuits 141 to 146. The digital-to-analog converter 230 may invert the voltage polarities of the analog image signals Y1 to Ym in response to the polarity control signal POL.

The test control unit 250 outputs a plurality of selection signals SEL1 to SELk (where k is a positive integer) in response to a test mode signal TEST_EN and a clock signal CLK included in the first control signal CONT1 which is provided from the driving control unit 120 shown in FIG. 1.

The output buffer unit 240 outputs data driving signals D1 to Dm, which correspond to each of the analog image signals Y1 to Ym, to a corresponding one of the data lines DL1-DLm in response to the test mode signal TEST_EN and the plurality of selection signals SEL1 to SELk.

For example, the output buffer unit 240 receives the analog image signals Y1 to Ym and provides the data driving signals D1 to Dm to a corresponding one of the data lines DL1 to DLm through a corresponding one of the pads P1 to Pm when the test mode signal TEST EN represents a normal mode. When the test mode signal TEST_EN represents a test mode, the output buffer unit 240 outputs the data driving signals D1 to Dm to the testable pads P1, P2, P3, Pm-2, Pm-1, and Pm.

Figure 3:
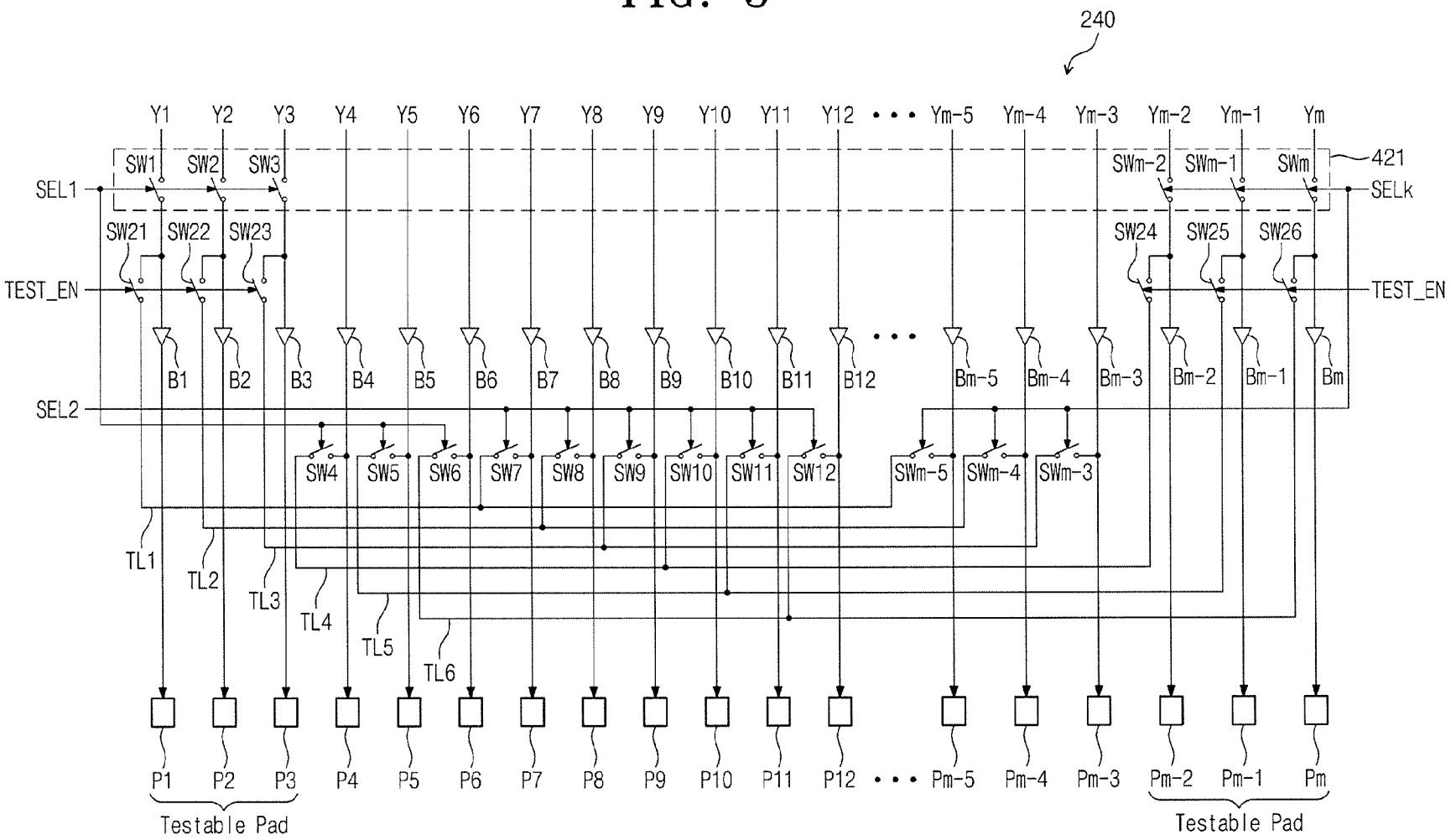
FIG. 3 is a view illustrating a circuit configuration of an output buffer unit shown in FIG. 2 according to an embodiment of the present inventive concept.

FIG. 3 is a view illustrating a circuit configuration of an output buffer unit shown in FIG. 2 according to an embodiment of the present disclosure.

Referring to FIG. 3, the output buffer unit 240 includes the plurality of pads P1 to Pm, which are respectively connected to the data lines DL1 to DLm shown in FIG. 1. As described above, the pads P1, P2, P3, Pm-2, Pm-1, and Pm are testable pads and in this case, the number of testable pads is six. However, the number of testable pads of the present inventive concept is not limited thereto.

The output buffer unit 240 further includes a switching circuit and a plurality of buffers B1 to Bm corresponding to each of the pads P1 to Pm. The switching circuit includes a first switching unit 421, a second switching unit, and a third switching unit. The first switching unit 421 includes switches SW1, SW2, SW3, SWm-2, SWm-1, and SWm. The second switching unit includes switches SW21, SW22, SW23, SW24, SW25, and SW26. The third switching unit includes switches SW4 to SWm-3.

The switch SW1 in the first switching unit 421 is connected between an output terminal (e.g., a terminal outputting the analog image signal Y1) of the digital-to-analog converter 230 and an input terminal of the buffer B1. The switch SW2 in the first switching unit 421 is connected between an output terminal (e.g., a terminal outputting the analog image signal Y2) of the digital-to-analog converter 230 and an input terminal of the buffer B2. The switch SW3 in the first switching unit 421 is connected between an output terminal (e.g., a terminal outputting the analog image signal Y3) of the digital-to-analog converter 230 and an input terminal of the buffer B3. The switches SW1 to SW3 operate in response to the selection signal SEL1.

The switch SW21 in the second switching unit is connected between a test output line TL1 and the input terminal of the buffer B1. The switch SW22 in the second switching unit is connected between a test output line TL2 and the input terminal of the buffer B2. The switch SW23 in the second switching unit is connected between a test output line TL3 and the input terminal of the buffer B3. The switches SW21, SW22, and SW23 operate in response to the test mode signal TEST EN.

The switch SW24 in the second switching unit is connected between a test output line TL4 and an input terminal of the buffer Bm-2. The switch SW25 in the second switching unit is connected between a test output line TL5 and an input terminal of the buffer Bm-1. The switch SW26 in the second switching unit is connected between a test output line TL6 and an input terminal of the buffer Bm. The switches SW24, SW25, and SW26 operate in response to the test mode signal TEST EN.

First ends of the switches SW4 to SWm-3 in the third switching unit are respectively connected to output terminals of the buffers B4 to Bm-3. In addition, second ends of the switches SW7 and SWm-5 among the switches SW4 to SWm-3 in the third switching unit are connected to the test output line TL1, second ends of the switches SW8 and SWm-4 among the switches SW4 to SWm-3 in the third switching unit are connected to the test output line TL2, and second ends of the switches SW9 and SWm-3 among the switches SW4 to SWm-3 in the third switching unit are connected to the test output line TL3. In addition, second ends of the switches SW4 and SW10 among the switches SW4 to SWm-3 in the third switching unit are connected to the test output line TL4, second ends of the switches SW5 and SW11 among the switches SW4 to SWm-3 in the third switching unit are connected to the test output line TL5, and second ends of the switches SW6 and SW12 among the switches SW4 to SWm-3 in the third switching unit are connected to the test output line TL6. The switches SW1 to SW3 in the first switching unit 421 and the switches SW4 to SW6 in the third switching unit operate in response to the selection signal SEL 1. The switches SW7 to SW12 in the third switching unit operate in response to the selection signal SEL2. The switches SWm-2 to SWm in the first switching unit 421 and the switches SWm-5 to SWm-3 in the third switching unit operate in response to the selection signal SELK.

When the test mode signal TEST EN is in a first level (for example, a low level), the test control unit 250 shown in FIG. 2 outputs the selection signals SEL1 to SELk of the first level (for example, a low level).

When the test mode signal TEST_EN is in a first level representing a normal mode, the output buffer unit 240 operates in the normal mode. The switches SW21 to S26 in the second switching unit are turned off in response to the test mode signal TEST_EN having the first level. In this case, the test output line TL1 and the buffer B1 are not connected to each other, the test output line TL2 and the buffer B2 are not connected to each other, and the test output line TL3 and the buffer B3 are not connected to each other. In response to the selection signals SEL1 to SELk having the first level, the switches SW1 to SW3, and SWm-2 to SWm in the first switching unit 421 and the switches SW4 to SWm-3 in the third switching unit are turned off.

Therefore, during the normal mode, the output buffer unit 240 receives the analog image signals Y1 to Ym outputted from the digital-to-analog converter 230 shown in FIG. 2 and provides the data driving signals D1 to Dm to a corresponding one of the data lines DL1 to DLm through a corresponding one of the pads P1 to Pm. The data driving signals D1 to Dm may correspond to each of the analog image signals Y1 to Ym.

Figure 4:
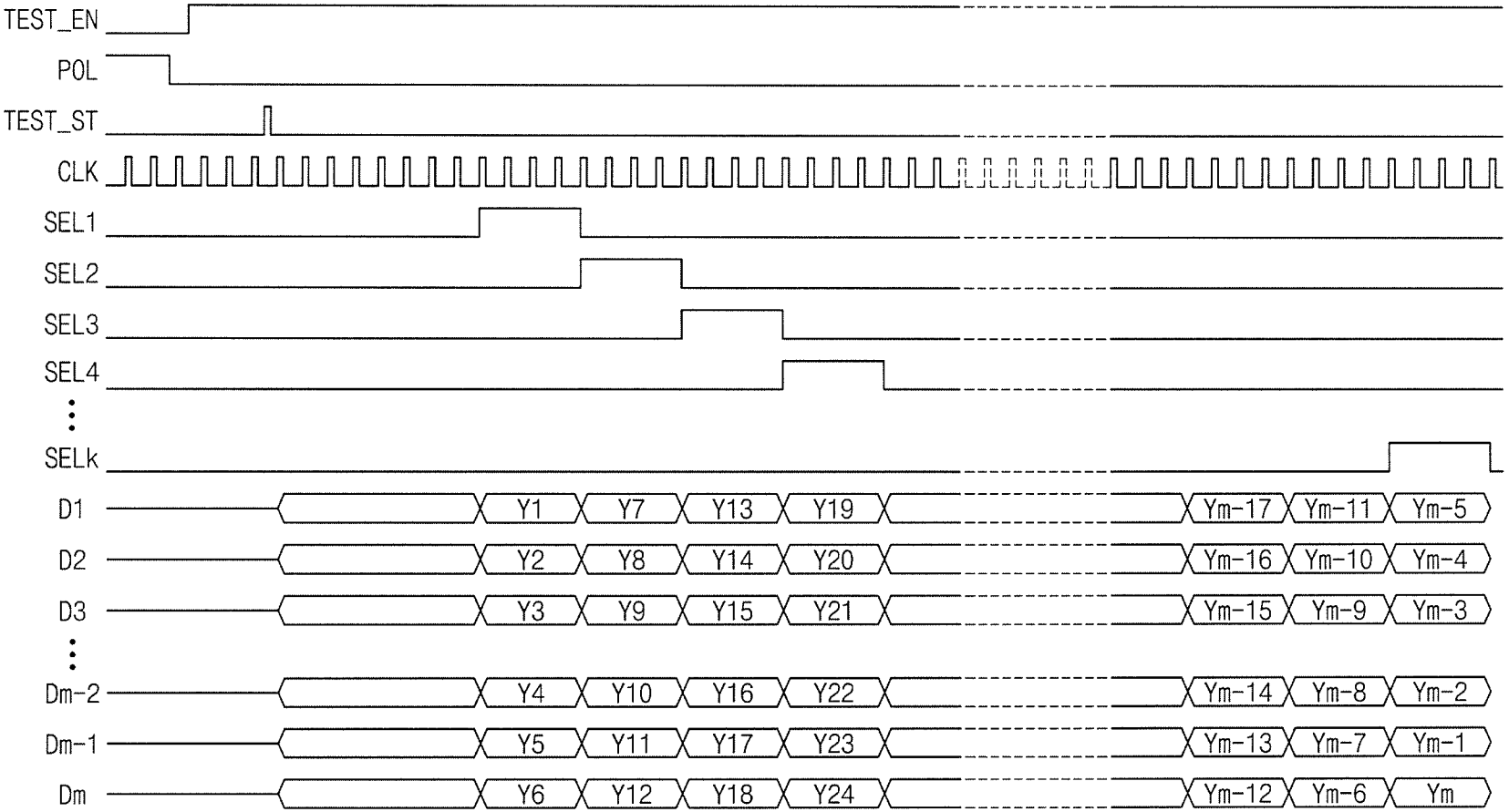
FIG. 4 is a timing diagram illustrating an operation of the output buffer unit shown in FIG. 3 during a test mode according to an embodiment of the present inventive concept.

FIG. 4 is a timing diagram illustrating an operation of the output buffer unit shown in FIG. 3 during a test mode.

Referring to FIGS. 2, 3, and 4, when the test mode signal TEST_EN is changed to a second level (for example, a high level) from, e.g., the first level, and a predetermined time elapses, the test control unit 250 internally activates a test start signal TEST_ST. When the test start signal TEST_ST is activated, the test control unit 250 sequentially activates the selection signals SEL1 to SELk in synchronization with the clock signal CLK. The test control unit 250 sequentially activates the selection signals SEL1 to SELk every four periods of the clock signal CLK. For example, when the test start signal TEST_ST is activated, the test control unit 250 activates the selection signal SEL1 in synchronization with the clock signal CLK, and after four clock cycles elapse, the next selection signal SEL2 is activated.

In response to the test mode signal TEST_EN having the second level, the switches SW21 to SW26 in the second switching unit are turned on. When the selection signal SEL1 is activated, the switches SW1 to SW3 in the first switching unit and the switches SW4 to SW6 in the second switching unit are turned on.

Therefore, the analog image signal Y1 is outputted to the testable pad P1 through the switch SW1 and the buffer B 1, the analog image signal Y2 is outputted to the testable pad P2 through the switch SW2 and the buffer B2, and the analog image signal Y3 is outputted to the testable pad P3 through the switch SW3 and the buffer B3. In addition, the analog image signal Y4 is outputted to the testable pad Pm-2 through the buffer B4, the switch SW4, the switch SW24, and the buffer Bm-2, the analog image signal Y5 is outputted to the testable pad Pm-1 through the buffer B5, the switch SW5, the switch SW25, and the buffer Bm-1, and the analog image signal Y6 is outputted to the testable pad Pm through the buffer B6, the switch SW6, the switch SW26, and the buffer Bm. For example, the analog image signals Y1 to Y6 are simultaneously outputted through a corresponding one of the testable pads P1, P2, P3, Pm-2, Pm-1, and Pm.

In addition, when the selection signal SEL2 is activated, the analog image signal Y7 is outputted to the testable pad P1 through the buffer B7, the switch SW7, and the switch SW21, the analog image signal Y8 is outputted to the testable pad P2 through the buffer B8, the switch SW8, and the switch SW22, and the analog image signal Y9 is outputted to the testable pad P3 through the buffer B9, the switch SW9, and the switch SW23. In addition, the analog image signal Y10 is outputted to the testable pad Pm-2 through the buffer B 10, the switch SW10, the switch SW24, and the buffer Bm-2, the analog image signal Y11 is outputted to the testable pad Pm-1 through the buffer B11, the switch SW11, the switch SW25, and the buffer Bm-1, and the analog image signal Y12 is outputted to the testable pad Pm through the buffer B12, the switch SW12, the switch SW26, and the buffer Bm. For example, the analog image signals Y7 to Y12 are simultaneously outputted through a corresponding one of the testable pads P1, P2, P3, Pm-2, Pm-1, and Pm.

In addition, when the selection signal SELk is activated, the analog image signal Ym-5 is outputted to the testable pad P1 through the buffer Bm-5, the switch SWm-5, and the switch SW21, the analog image signal Ym-4 is outputted to the testable pad P2 through the buffer Bm-4, the switch SWm-4, and the switch SW22, and the analog image signal Ym-3 is outputted to the testable pad P3 through the buffer Bm-3, the switch SWm-3, and the switch SW23. In addition, the analog image signal Ym-2 is outputted to the testable pad Pm-2 through the switch SWm-2 and the buffer Bm-2, the analog image signal Ym-1 is outputted to the testable pad Pm-1 through the switch SWm-1 and the buffer Bm-1, and the analog image signal Ym is outputted to the testable pad Pm through the switch SWm and the buffer Bm. For example, the analog image signals Ym-5 to Ym are simultaneously outputted through a corresponding one of the testable pads P1, P2, P3, Pm-2, Pm-1, and Pm.

Since the selection signals SEL1 to SELk are sequentially activated as described above, the analog image signals Y1 to Ym are sequentially outputted to the testable pads P1 to P3, and Pm-2 to Pm. During a test mode, the polarity control signal POL included in the first control signal CONT1, which is provided from the driving control unit 120 shown in FIG. 1 to the data driving circuits 141 to 146, has a second level (for example, a high level). During a test mode, the driving control unit 120 shown in FIG. 1 may provide a predetermined test data signal to the data driving circuits 141 to 146 as the data signal DATA.

An area of each of the testable pads P1 to P3, and Pm-2 to Pm is broader area than an area of each of the pads P4 to Pm-3, and thus, the testable pads P1 to P3 may easily contact a probe. The pads P4 to Pm-3 can be designed with a minimum size such that they are connected to a corresponding one of the data lines D4 to DLm-3. Therefore, while the sizes of the data driver ICs 151 to 156 shown in FIG. 1 are minimized, the data driver ICs 151 to 156 can be tested.

A display device according to an embodiment of the present inventive concept may have a relatively small number of testable pads in a data driver IC which is a subject under test.

The foregoing is illustrative of exemplary embodiments of the present inventive concept and the present inventive concept should not be construed as being restrictive to the exemplary embodiments disclosed herein. Although a few exemplary embodiments have been described, it will be understood that various modifications in forms and detail may be made therein without departing from the spirit and scope of the present inventive concept.

What is claimed is:

1. A display device comprising:

a display panel including a plurality of pixels, each of which is connected to a corresponding one of a plurality of gate lines and a corresponding one of a plurality of data lines;

a gate driver configured to drive the plurality of gate lines;

a data driver including a plurality of pads, the plurality of pads including a first group of pads and a second group of pads, wherein each of the first group of pads is connected to each of a first group of data lines of the plurality of data lines, and each of the second group of pads is connected to each of a second group of data lines of the plurality of data lines; and a driving control unit configured to provide control signals and a data signal to the data driver, and to control the gate driver, wherein the data driver comprises:

a digital-to-analog converter configured to convert the data signal into a plurality of analog signals corresponding to each of the plurality of data lines; and a switching circuit configured to connect each of a plurality of terminals of the digital-to-analog converter to a corresponding one of the plurality of pads at substantially the same time during a normal mode, wherein, during a test mode, the switching circuit is further configured to connect each of a first group of output terminals of the plurality of output terminals to a corresponding one of the first group of pads in a first period, and to connect each of a second group of output terminals of the plurality of output terminals to a corresponding one of the first group of pads in a second period subsequent to the first period.

2. The display device of claim 1, wherein at least one of the first group of pads contacts a probe.

3. The display device of claim 1, wherein the control signals comprises a test mode signal and a clock signal, wherein the test mode signal indicates the normal mode or the test mode.

4. The display device of claim 3, wherein the data driver further comprises a test control unit configured to output a plurality of selection signals in response to the test mode signal.

5. The display device of claim 4, wherein the data driver further comprises a plurality of buffers corresponding to each of the plurality of pads.

6. The display device of claim 5, wherein the switching circuit comprises a first switching unit configured to provide a first group of analog signals of the plurality of analog signals to a corresponding one of a first group of buffers of the plurality of buffers in response to a first selection signal of the plurality of selection signals, and wherein each of the first group of buffers corresponds to each of the first group of pads.

7. The display device of claim 6, wherein the switching circuit further comprises:

a plurality of test output lines;

a second switching unit configured to connect each of the plurality of test output lines to a corresponding one of a second group of buffers of the plurality of buffers in response to the test mode signal, each of the second group of buffers corresponding to each of the first group of pads; and a third switching unit configured to connect each of a third group of buffers of the plurality of buffers to one of the plurality of test output lines in response to a corresponding selection signal of the plurality of selection signals.

8. The display device of claim 4, wherein the test control unit output the plurality of selection signals in synchronization with the clock signal when the test mode signal is in a first level.

9. The display device of claim 8, wherein the test control unit sequentially activates the plurality of selection signals every predetermined period of the clock signal when the test mode signal is in the first level.

10. The display device of claim 1, wherein an area of each of the first group of pads is broader than an area of each of the second group of pads.

11. A data driver comprises:

a digital-to-analog converter configured to convert a data signal into a plurality of analog signals corresponding to each of a plurality of data lines;

a test control unit configured to output a plurality of selection signals in response to a test mode signal;

a plurality of pads each connected to a corresponding one of the plurality of data lines, the plurality of pads including a first group of pads and a second group of pads;

a switching circuit configured to output each of a first group of the plurality of analog signals to a corresponding one of the first group of pads in a first period, and to output each of a second group of the plurality of analog signals to a corresponding one of the first group of pads in a second period subsequent to the first period during a test mode.

12. The data driver of claim 11, wherein at least one of the first group of pads contacts a probe.

13. The data driver of claim 11, further comprises a plurality of buffers corresponding to each of the plurality of pads.

14. The data driver of claim 13, wherein the switching circuit comprises a first switching unit configured to provide a first group of analog signals of the plurality of analog signals to a corresponding one of a first group of buffers of the plurality of buffers in response to a first selection signal of the plurality of selection signals, and wherein each of the first group of buffers corresponds to each of the first group of pads.

15. The display device of claim 14, wherein the switching circuit further comprises:

a plurality of test output lines; and a second switching unit configured to connect each of the plurality of test output lines to a corresponding one of a second group of buffers of the plurality of buffers in response to the test mode signal, the second group of buffers corresponding to each of the first group of pads.

16. The display device of claim 15, wherein the switching circuit further comprises a third switching unit configured to connect each of a third group of buffers of the plurality of buffers to one of the plurality of test output lines in response to a corresponding selection signal of the plurality of selection signals.

17. The data driver of claim 11, wherein an area of each of the first group of pads is broader than an area of each of the second group of pads.

* * * * *